US009438977B2

(12) United States Patent
Wang et al.

(10) Patent No.: US 9,438,977 B2
(45) Date of Patent: Sep. 6, 2016

(54) OUTLET MECHANISM WITH ADDITIONAL FUNCTION

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Lei Wang, Xiamen (CN); Wenbin Fan, Xiamen (CN); Bin Cao, Xiamen (CN); Huasong Zhou, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 0 days.

(21) Appl. No.: 14/532,375

(22) Filed: Nov. 4, 2014

(65) Prior Publication Data

US 2015/0122913 A1 May 7, 2015

(30) Foreign Application Priority Data

Nov. 7, 2013 (CN) ..... 2013 1 0549418

(51) Int. Cl.

| | |
|---|---|
| ***B05B 1/18*** | (2006.01) |
| ***H04R 1/02*** | (2006.01) |
| ***B05B 15/00*** | (2006.01) |
| ***B05B 15/06*** | (2006.01) |
| ***E03C 1/04*** | (2006.01) |
| ***E03C 1/046*** | (2006.01) |

(52) U.S. Cl.

CPC ..... *H04R 1/028* (2013.01); *B05B 1/18* (2013.01); *B05B 15/00* (2013.01); *B05B 15/061* (2013.01); *E03C 1/046* (2013.01); *E03C 1/0409* (2013.01)

(58) Field of Classification Search

CPC ..... B05B 15/065; B05B 15/00; B05B 15/06; B05B 15/061; B05B 1/14; B05B 1/16; B05B 1/18; E03C 1/06; E03C 1/02; E03C 1/04; E03C 1/0409; E03C 1/046; H04R 1/028; H04R 1/02; H04R 1/00

USPC ..... 239/289, 556–558, 559, 560, 588, 443

See application file for complete search history.

(56) References Cited

U.S. PATENT DOCUMENTS 7,837,133 B2 * 11/2010 Zhou ..... B05B 1/185 239/282

2007/0158460 A1 * 7/2007 Lev ..... B05B 1/1672 239/132.1

* cited by examiner

*Primary Examiner* — Christopher Kim

(74) *Attorney, Agent, or Firm* — Rabin & Berdo, P.C.

(57) ABSTRACT

The present invention is provided with an outlet mechanism with additional function, which comprises a fixation base, a hand shower and an additional module. The fixation base is assembled to a shower arm with an inlet, an outlet and a waterway connecting the inlet and the outlet, the inlet is connected to the shower arm. The hand shower is connected to the outlet of the fixation base by a flexible pipe and is detachably fixedly connected to the fixation base. The additional module detachably attached to the fixation base. The present invention has advantages: with the additional function, for example it can play music or give off perfume, the structure is simple with fewer components, the configuration is reasonable, and the structure is compact.

16 Claims, 10 Drawing Sheets

OUTLET MECHANISM WITH ADDITIONAL FUNCTION

FIELD OF THE INVENTION

The present invention relates to an outlet mechanism with additional function.

BACKGROUND OF THE INVENTION

Exiting outlet mechanisms comprise a water joint, a hand shower and a wall set, the water joint is assembled to a shower arm, the hand shower is connected to the water joint via flexible pipe, the wall set is fixed to the wall for the hand shower to hold the hand shower. However, existing outlet mechanisms are single used, with many components, complicated structural, thus needed to be improved.

SUMMARY OF THE INVENTION

The present invention is provided with an outlet mechanism with additional function, which overcomes the disadvantages of the existing outlet mechanisms.

The technical proposal of the present invention to solve the technical problem is that:

An outlet mechanism with additional function, comprising:

a fixation base assembled to a shower arm with an inlet, an outlet and a waterway connecting the inlet and the outlet, the inlet is connected to the shower arm;

a hand shower connected to the outlet of the fixation base by a flexible pipe and detachably fixedly connected to the fixation base; and an additional module detachably attached to the fixation base.

In another preferred embodiment, the hand shower is disposed with a throughout assembly hole, the hand shower is disposed with movable lock catch, an elastic element and an operation element, the movable lock catch is movably attached to the hand shower and moves between a lock position and an unlock position inside the assembly hoe, the elastic element is connected to the movable lock catch and the hand shower so as to make the movable lock catch kept in the lock position, the operation element is drivingly connected to the movable lock catch and is movably attached to the hand shower;

In another preferred embodiment, an external periphery of the fixation base is concaved with a positioning groove, the assembly hole of the hand shower is sleeved on the outside of the fixation base, the movable lock catch, when in the lock position, inserts into the positioning groove.

In another preferred embodiment, the fixation base comprises an upper housing and an lower housing, the lower housing is fixed to the upper housing, the lower housing is disposed with an annular protruding extending outwardly, said positioning groove is formed between the bottom surface of the upper housing and the annular protruding and is annular shaped.

In another preferred embodiment, the movable lock catch is slidably connected to the hand shower.

In another preferred embodiment, the operation element is slidably connected to the hand shower and is disposed with a first inclined surface, the movably lock catch is disposed with a second inclined surface, the first inclined surface is coupled to abut on the second inclined surface.

In another preferred embodiment, the fixation base comprises an upper housing and a lower housing, the lower housing is fixed to the upper housing, the lower housing comprises a baffle and a lower periphery wall extending downwardly from the periphery of the baffle, the assembly groove is formed in the inner side of the lower periphery wall; an inner cover is disposed at the outer side of the additional module, the inner cover is detachably assembled inside the assembly groove of the lower housing.

In another preferred embodiment, the fixation base is disposed with a first magnet therein, the inner cover is disposed with a second magnet therein, the first magnet and the second magnet attracts each other.

In another preferred embodiment, the additional module is a Bluetooth music player module.

In another preferred embodiment, the additional module is an aromatherapy module.

In another preferred embodiment, the fixation base further comprises an impeller fixation base fixedly attached between the upper housing and the baffle, the impeller fixation base comprises an water inlet, an water outlet and a cavity connecting the water inlet and the water outlet; the impeller fixation base is pivotly disposed with a first rotation shaft, the first rotation shaft is fixedly disposed with an impeller, the impeller rotates under the compact of water, the waterway comprises at least the water inlet, the water outlet and the cavity;

a fan is disposed in the inner cover, the fan is disposed with a second rotation shaft, the first rotation shaft rotatably runs through the baffle and is coaxially fixedly attached to the second rotation shaft.

Compared to existing technology, the technical proposal of the present invention has advantages as below:

The outlet mechanism comprises a fixation base, a hand shower and an additional module, the additional module is detachably attached to the fixation base, the hand shower is connected to the outlet of the fixation base via flexible pipe and is detachably fixedly connected to the fixation base, so that with the additional function, for example it can play music or give off perfume, the structure is simple with fewer components, the configuration is reasonable, and the structure is compact.

The hand shower is disposed with a movable lock catch, an elastic element and an operation element, the assembly hole of the hand shower is sleeved on the outer side of the fixation base, the movable lock catch in lock position inserts into the positioning groove, so that the fixation is stable and reliable, the assembly and disassembly are convenient and quick, the structure is simple.

The annular positioning groove is formed between the bottom surface of the upper housing and the annular protruding, so that it can be assembled or disassembly quickly and conveniently, the connection is stable and reliable.

The lower housing comprises a baffle and a lower periphery wall extending downwardly from the periphery of the baffle, the assembly groove is formed in the lower periphery wall; the additional module is disposed with an inner cover at the outer side, the inner cover is detachably assembled inside the assembly groove of the lower housing, the structure is compact, the appearance is attractive, the additional function is convenient and quick to assemble or disassemble.

The water diversion is disposed with a first magnet therein, the inner cover is disposed with a second magnet therein, the first magnet and the second magnet attract each other, thus making it convenient to assemble or disassemble.

BRIEF DESCRIPTION OF THE DRAWINGS

The present invention will be further described with the drawings and the embodiments.

FIG. 4-1 illustrates a schematic diagram of the movable lock catch of the outlet mechanism.

DETAILED DESCRIPTION OF THE EMBODIMENTS

Please refer to FIG. 1 to FIG. 7, an outlet mechanism with an additional function is provided to assembled to a shower arm 10, the shower arm is a water supply pipe fixed to the wall. The outlet mechanism comprises a fixation base 20, a hand shower 30 and an additional module 40.

Figure 1:
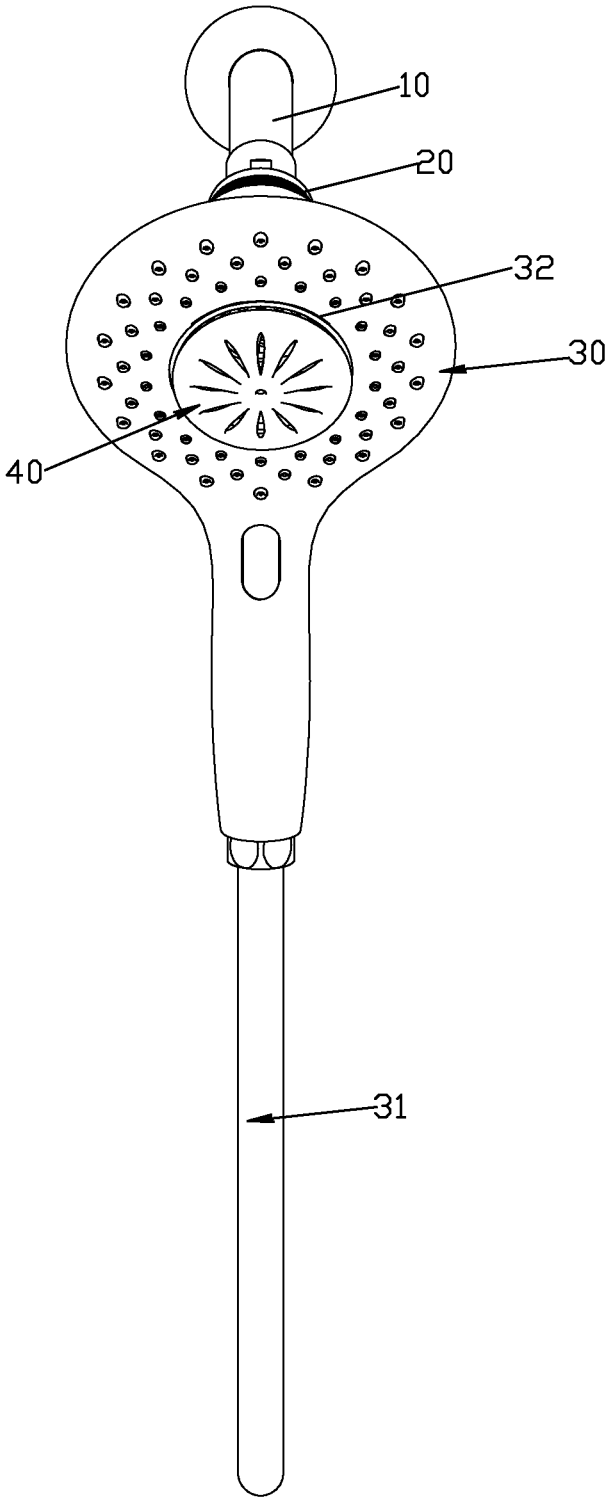
FIG. 1 illustrates a first schematic diagram of the outlet mechanism.
Figure 2:
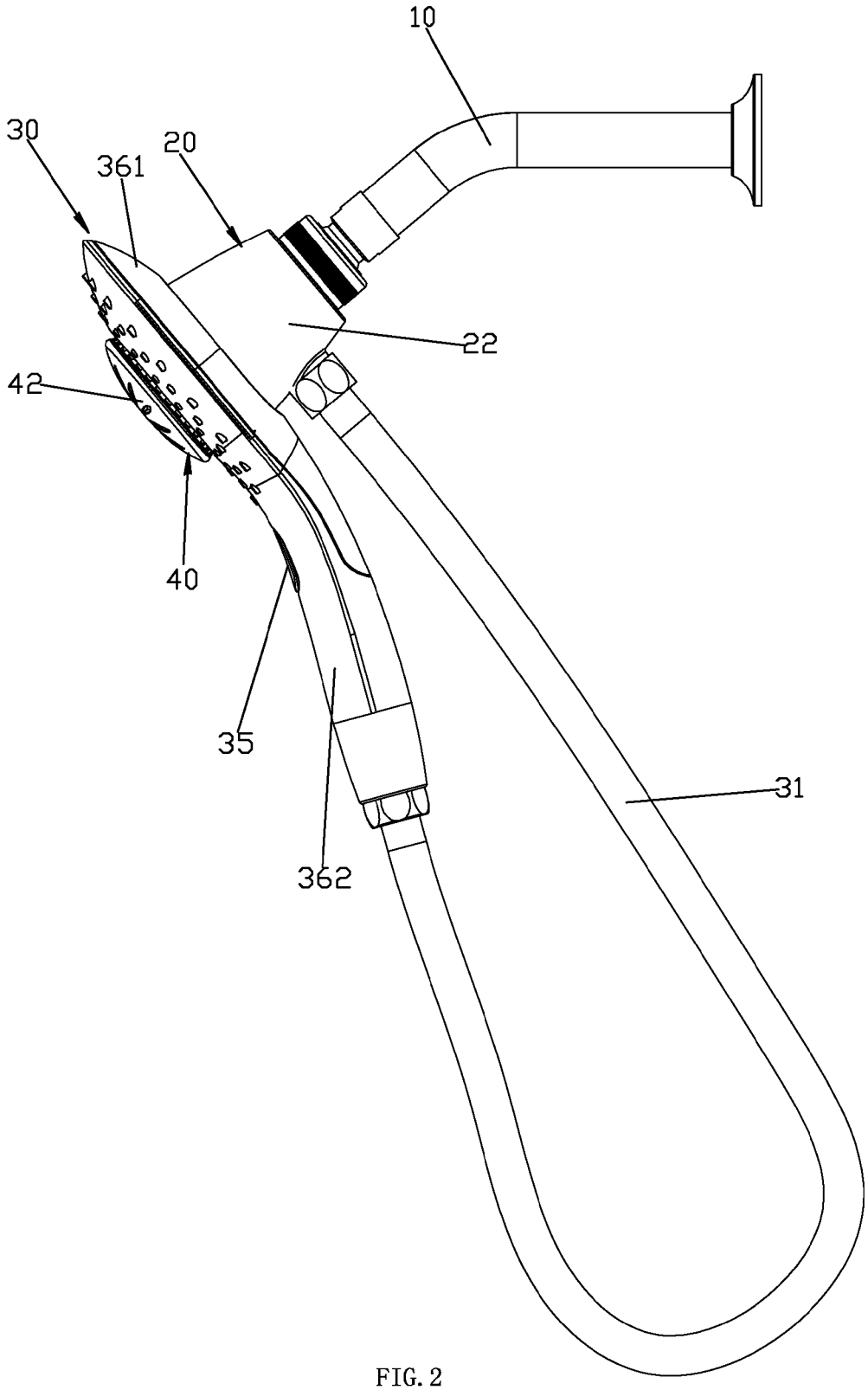
FIG. 2 illustrates a second schematic diagram of the outlet mechanism.
Figure 3:
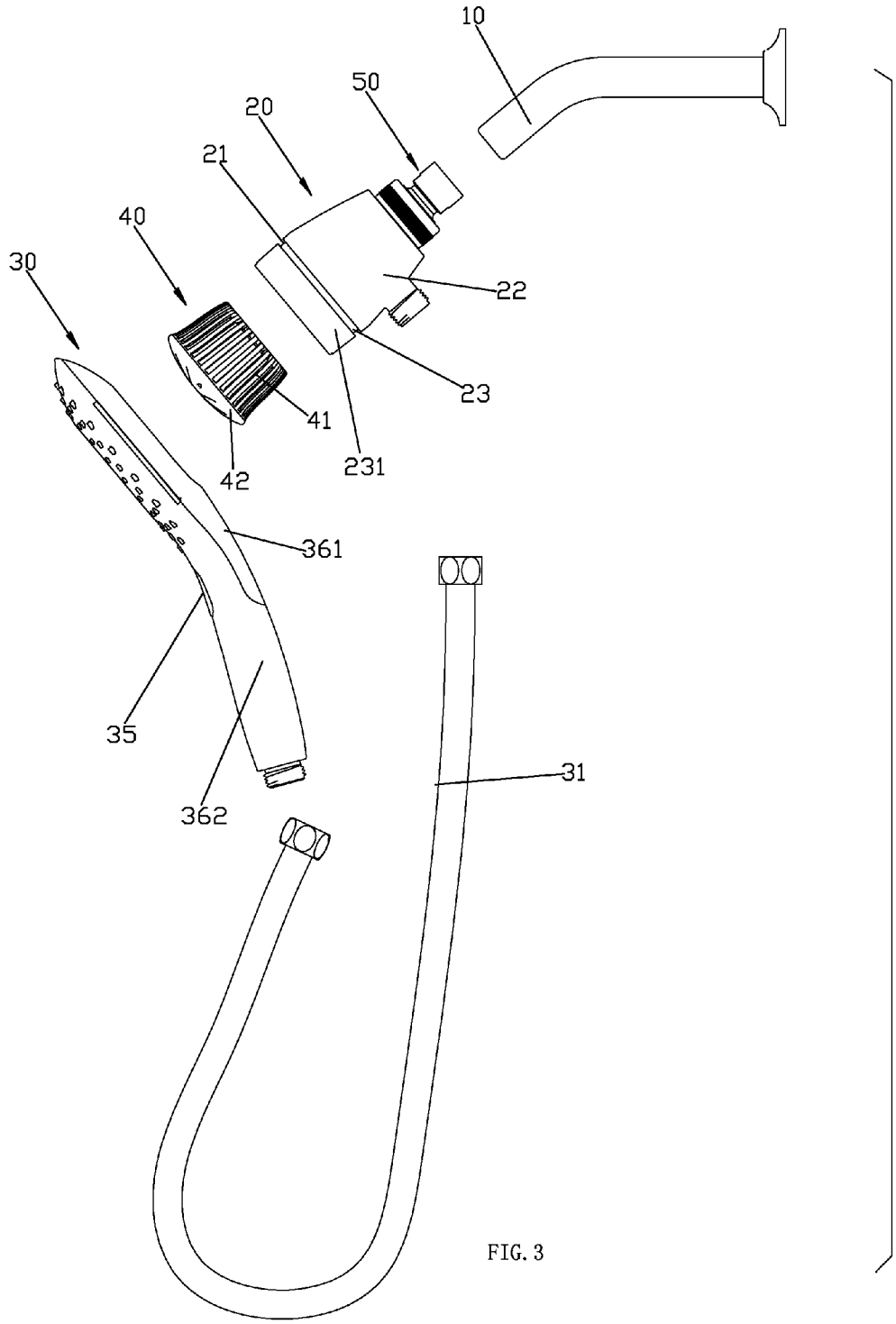
FIG. 3 illustrates an exploded and schematic diagram of the parts of the outlet mechanism.
Figures 1, 4:
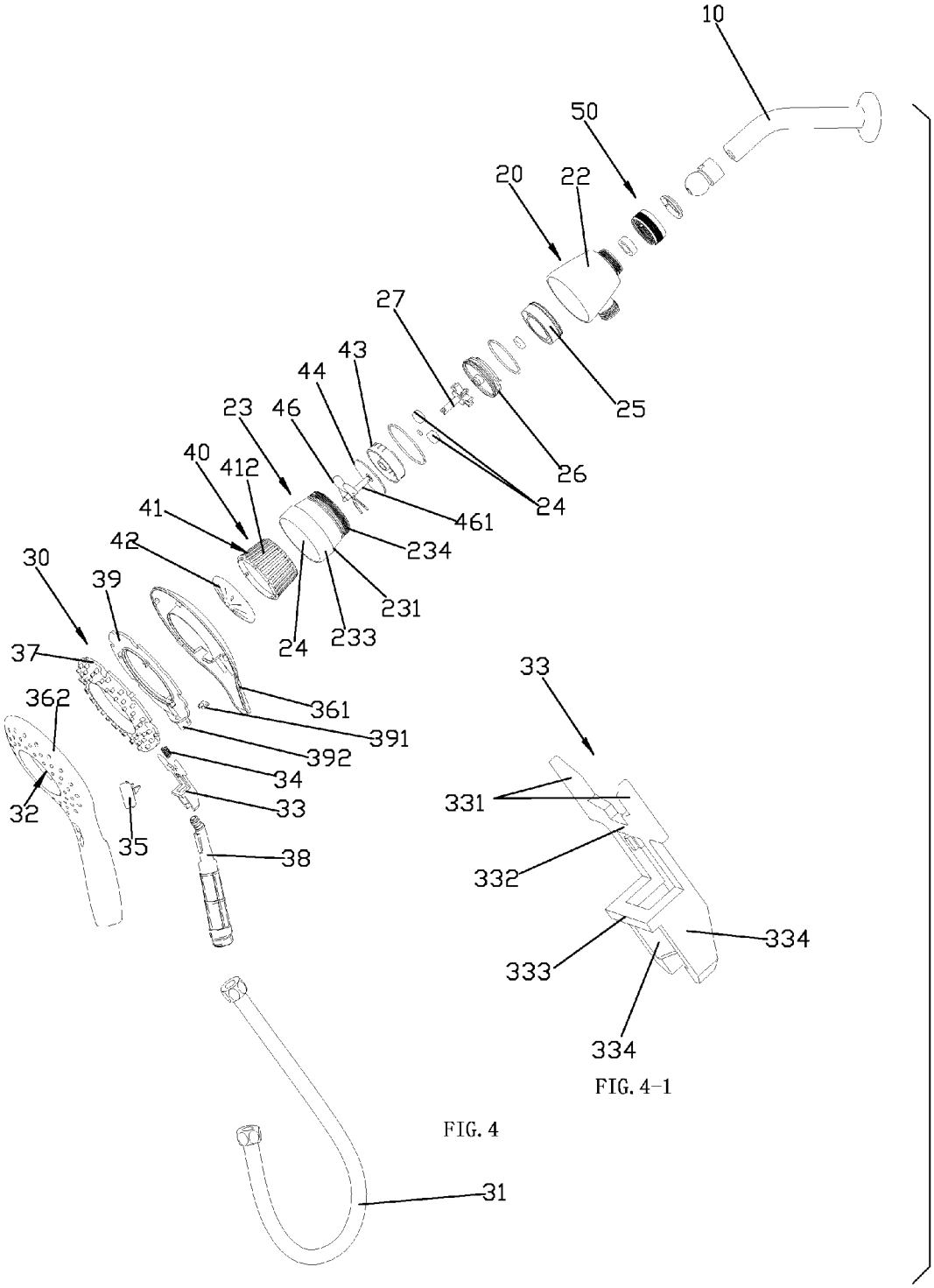
FIG. 4 illustrates an exploded and schematic diagram of the components of the outlet mechanism.
Figure 5:
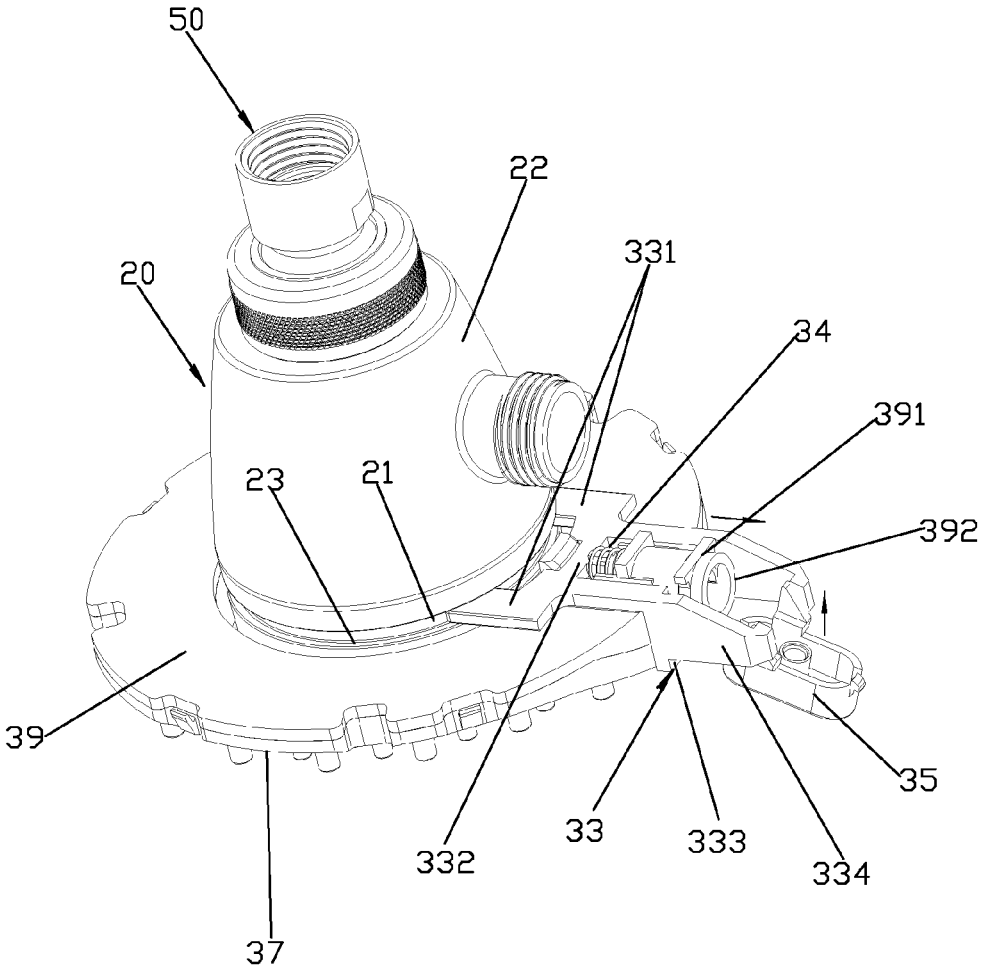
FIG. 5 illustrates a partial exploded and schematic diagram of the outlet mechanism.
Figure 6:
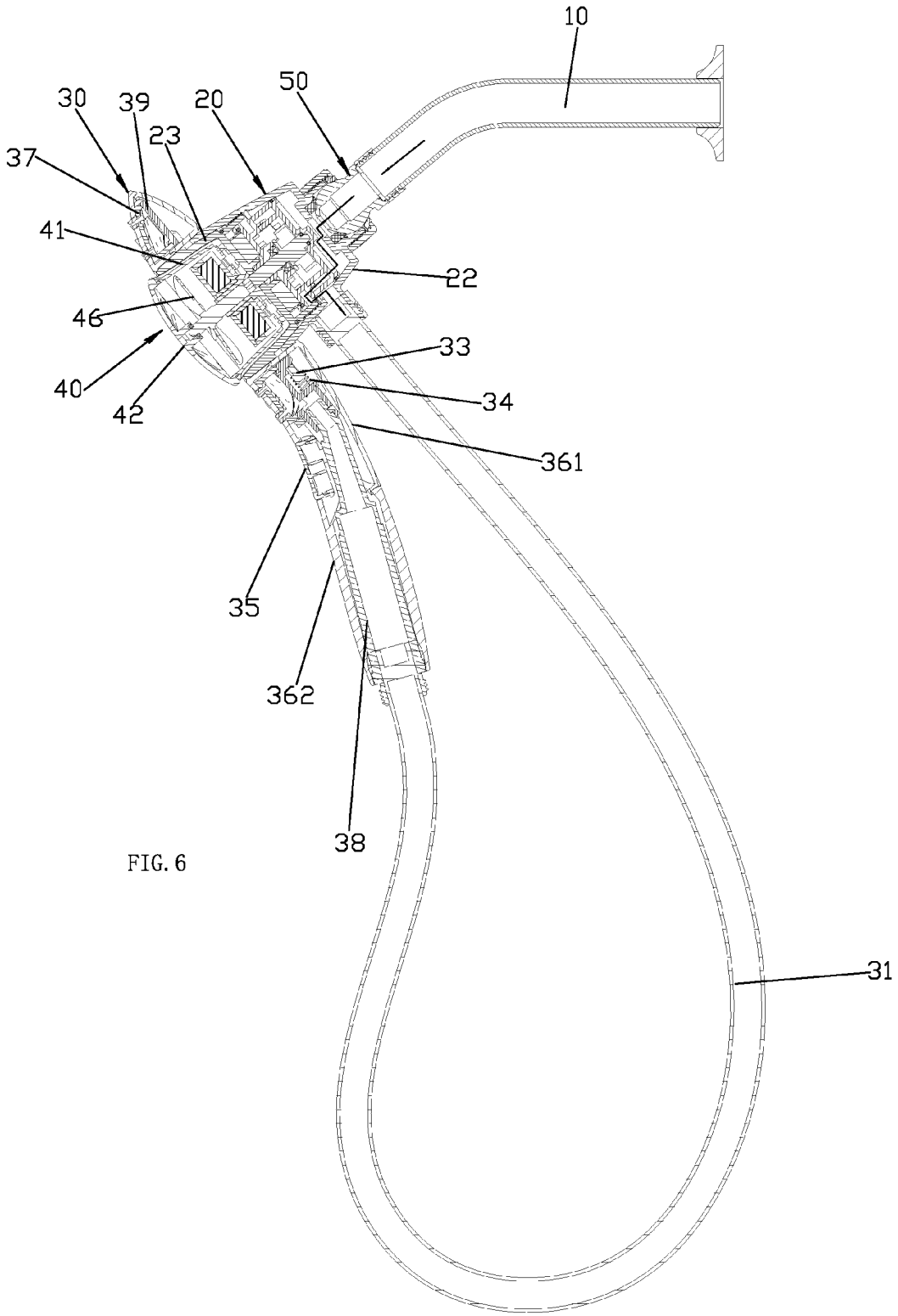
FIG. 6 illustrates a first sectional diagram of the outlet mechanism.
Figure 7:
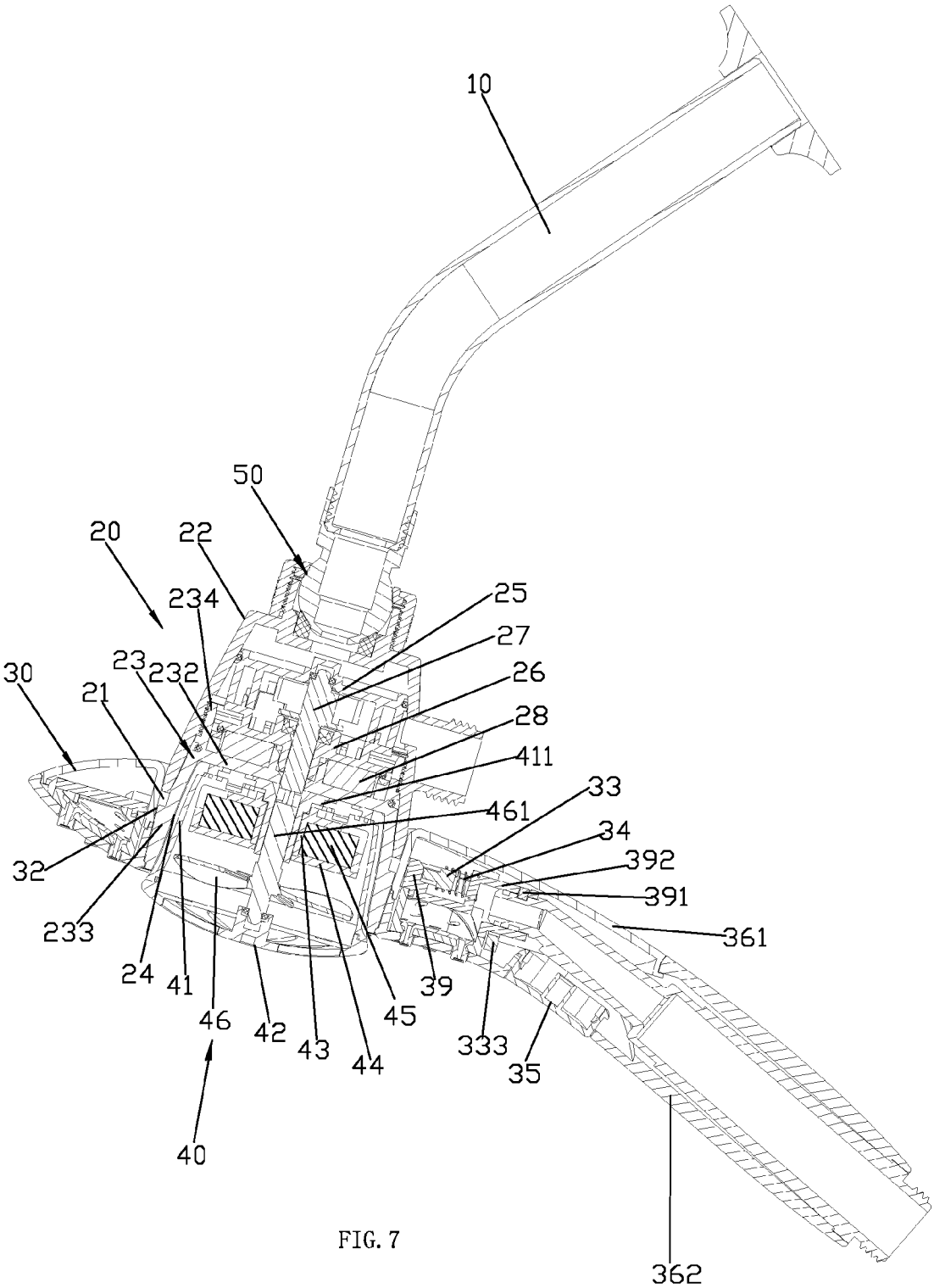
FIG. 7 illustrates a second sectional diagram of the outlet mechanism.
Figure 8:
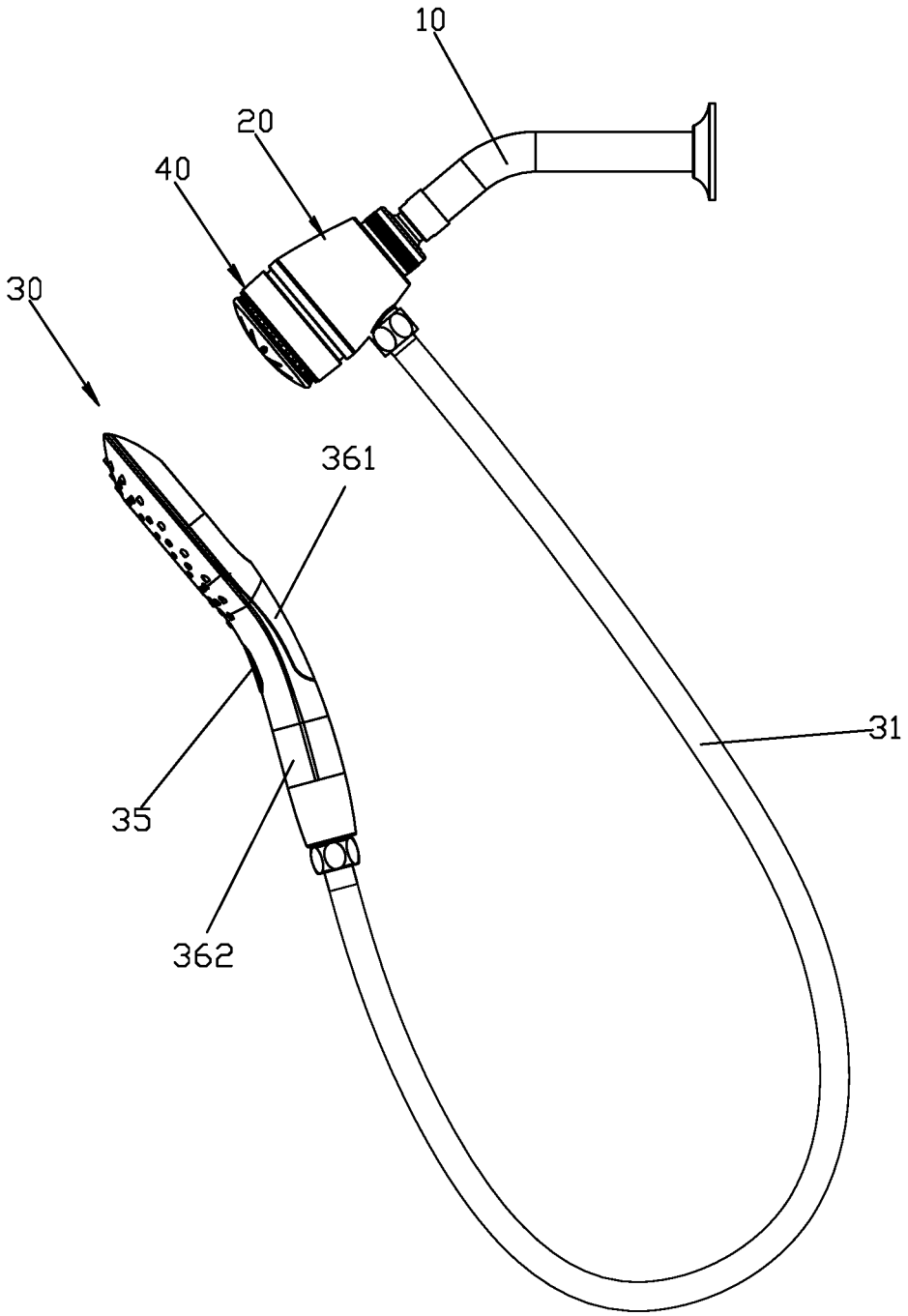
FIG. 8 illustrates a schematic diagram of a first using example of the outlet mechanism.
Figure 9:
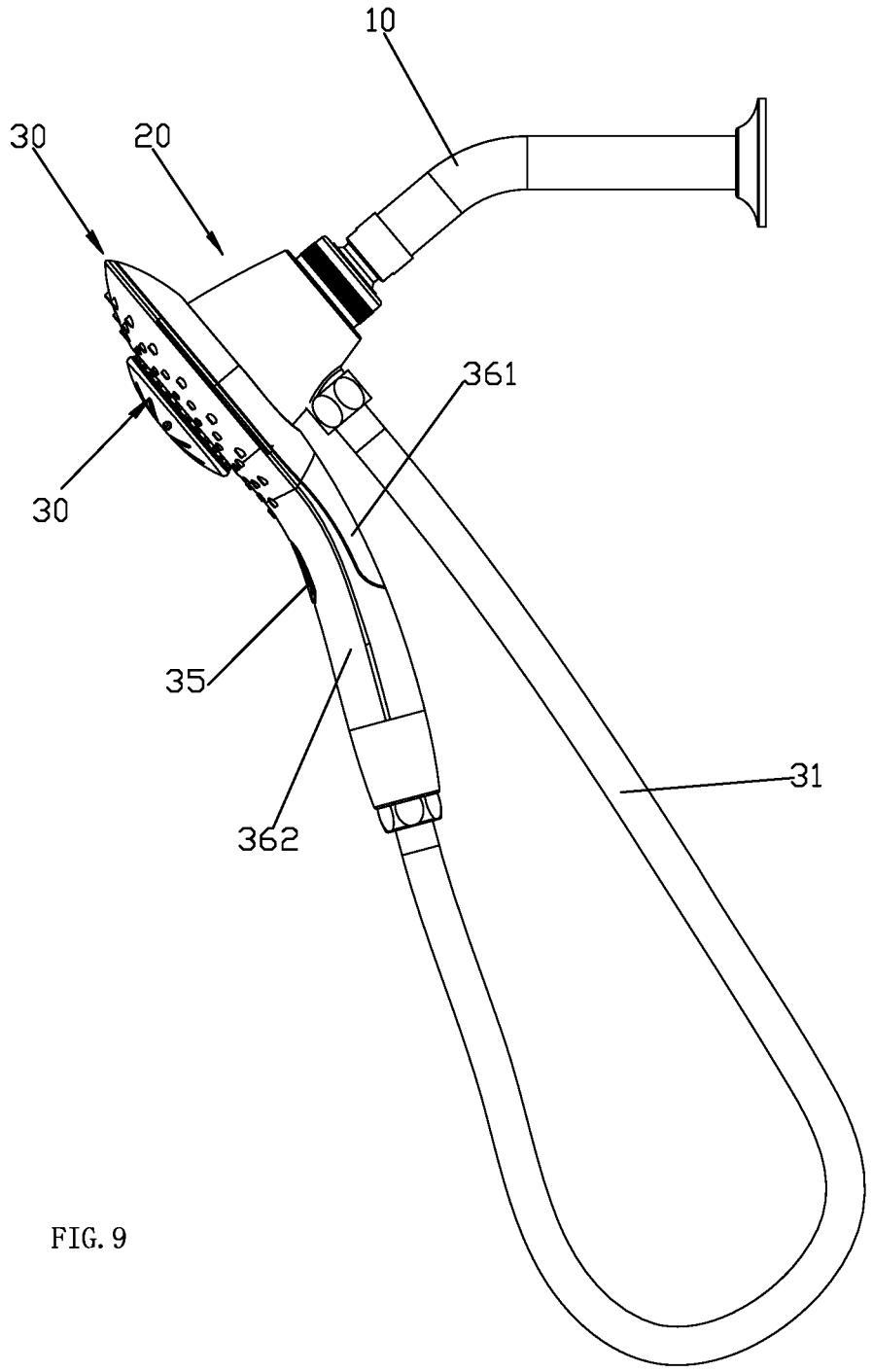
FIG. 9 illustrates a schematic diagram of a second using example of the outlet mechanism.
Figure 10:
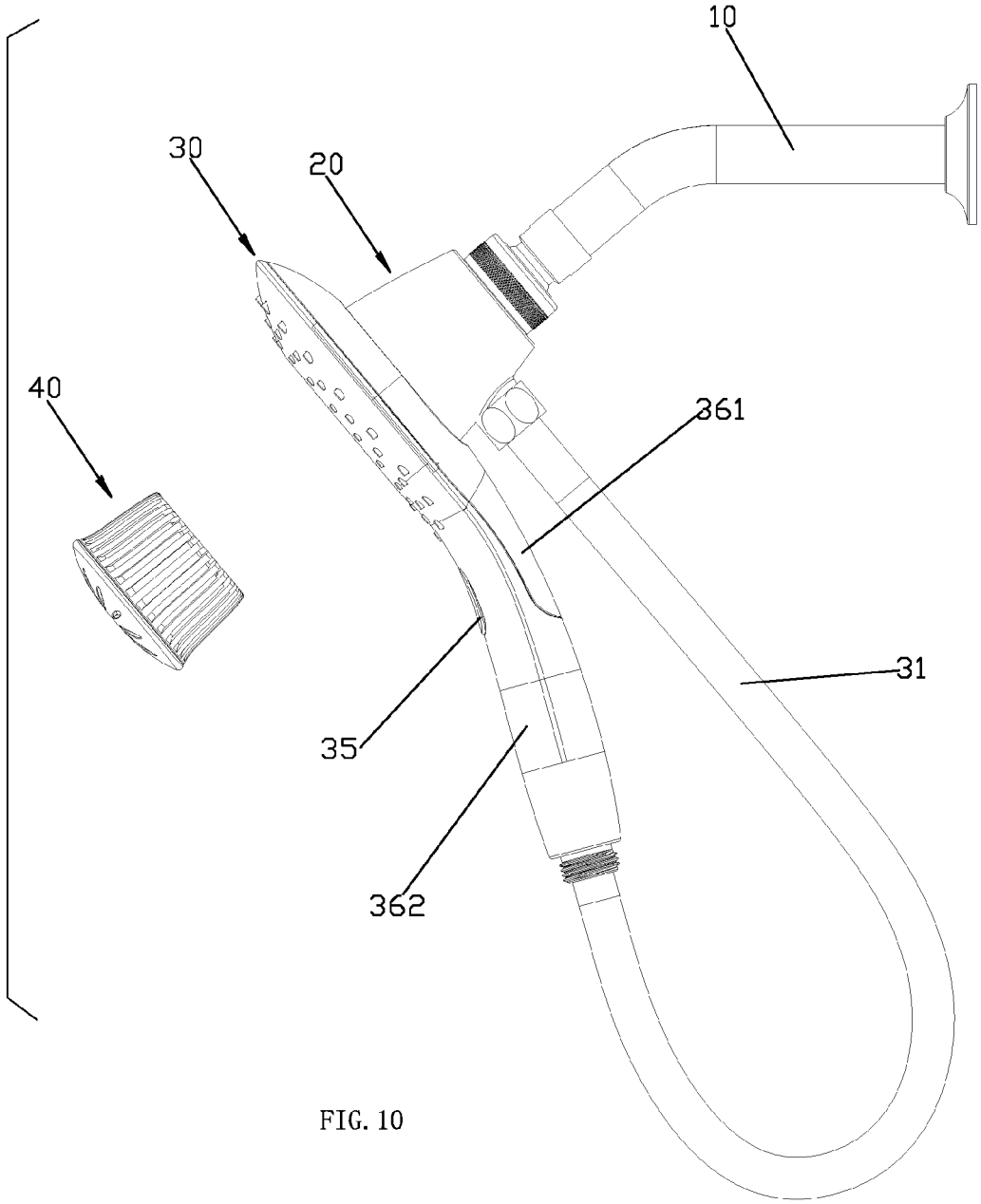
FIG. 10 illustrates a schematic diagram of a third using example of the outlet mechanism.

The fixation base 20 is available to attach to the shower arm 10. it is disposed with an inlet, an outlet and a waterway connected the inlet and the outlet, the inlet is connected to the shower arm 10, in this embodiment, the inlet is attached to the shower arm and is connected to the water supply of the shower arm 10. the hand shower 30 is connected to the outlet of the fixation base 20 via a flexible pipe 31, the hand shower 30 is detachably fixedly connected to the fixation base 20, so that the hand shower 30 can be taken down from the fixation base 20 to serve as a traditional hand shower, as figured in FIG. 8, or can be attached to the fixation base 20 to serve as a head shower, as figured in FIG. 9. The additional module 40 is detachably attached to the fixation base 20. In this embodiment, the fixation base 20 has three functions: water passage, wall set and additional module assembling, it is of simple structure, reasonable design and compact structure. The additional module 40 can be applied with a Bluetooth music player module for example, or an aromatherapy module, this embodiment is applied with an aromatherapy module.

The hand shower 30 is disposed with a throughout assembly hole 32, the hand shower 30 is disposed with a movable lock catch 33, an elastic element 34 and an operation element 35, the movable lock catch 33 is movably attached to the hand shower 30 and is movable between a lock position inserting into the assembly hole 32 and a unlock position away from the assembly hole 32, the elastic element 34 is connected to the movable lock catch 33 and the hand shower 30 to make the movable lock catch 33 kept in the lock position, the operation element 35 is drivingly connected to the movable lock catch 33 and is movably connected to the hand shower 30. the outer periphery of the fixation base 20 is concaved with a positioning groove 21, the assembly hole 32 of the hand shower is coupled to sleeved on the fixation base 20 and in this lock position, the movable lock catch 33 is inserted into the positioning groove 21, so as to fix the hand shower at the outer side of the fixation base 20, the movable lock catch 33 is in the unlock position when the operation element is pressed so as to take the hand shower down. Preferred, the movable lock catch 33 is slidably connected to the hand shower 30, but not limited to this, a rotational connection method is available as needed. Preferred, the fixation base 20 comprises an upper housing 22 and a lower housing 23, the lower housing 23 is protruded with an annular protruding 231 extending outwardly, the lower housing 231 is fixed inside the upper housing 22, the bottom surface of the upper housing 23 and the annular protruding 231 form above said annular positioning groove 21. Preferred, the operation element 35 is slidably connected to the hand shower 30, the operation element 35 can be a button with a first inclined surface, the movable lock catch is disposed with a second inclined surface, the first inclined surface is coupled to contact on the second inclined surface, so that the operation element, when pressed, can drive the movable lock catch to slide. The outer periphery of the lower housing is a revolution shape, the assembly hole is a circular hole.

In a preferred embodiment, the movable lock catch 33 is disposed with two inserting parts, when the movable lock catch 33 is in the lock position, the two inserting parts insert into the assembly hole, and then insert into the positioning groove 21 to thus lock, two inserting parts or more than two inserting parts make the lock stable and reliable. The movable lock catch 33 is disposed with a U-shaped piece 333 with openings faced upward and a lateral link 332; the lateral link 332 is fixed between the two inserting parts, two upper ends of the two openings of the U-shaped piece 333 are respectively fixed to the two inserting parts; the rear portions of the two openings of the U-shaped piece 333 are respectively further fixed with a side plate 334, two side plates 334 are parallel spaced arranged, the second inclined surface is disposed in the side plate. With the lateral link, the elastic element, for example a spring, can be disposed between the lateral link and the hand shower. With the U-shaped piece, the inner waterway of the hand shower, for example a spindle 38 can run through the U-shaped piece to connect to a fixation cover 39 of the hand shower.

In a detailed embodiment, the hand shower 30 comprises a main body, an outlet cover 37, a spindle 38 and a fixation cover 39. The main body comprises an upper main body 361 and a lower main body 362 oppositely fixedly arranged, the lower main body 362 is disposed with a hand portion and a main body portion fixedly connected, the main portions of the upper main body 361 and the lower main body 362 are oppositely fixedly arranged, the outlet cover 37 and the fixation cover 39 are fixedly attached between the main portion of the lower main body 362 and the upper main body 361. In an embodiment, the outlet cover and the fixation cover are fixedly attached via a C-shaped lock catch 391. In an embodiment, the fixation cover is disposed with an extending-out water supply pipe 392, the water supply pipe 392 is connected to the spindle 38, the spindle is connected to the flexible pipe to lead water in the flexible pipe to the outlet cover and then outlet; the movable lock catch 33 is slidably connected to the fixation cover 39, the U-shaped piece is sleeved on the water supply pipe 392, the inserting portion is slidably attached to the top surface of the fixation cover 39 so as to position the movable lock catch and the fixation cover, preferred, the upper main body and the lower main body couple to position the movable lock catch to insure the sliding direction of the movable lock catch; the elastic element abuts between the fixation cover and the movable lock catch. The operation element 35 is movably connected to the hand portion of the lower main body 362; the spindle 38 is arranged between the two side plates and is connected to the water supply pipe 392.

The fixation base 20 comprises an upper housing 22 and a lower housing 23. the upper housing 22 is assembled to the support 10 via a joint component 50, the joint component 50 is applied with existing technology, so that it will not be described here. The lower housing 23 comprises a baffle 232, a lower periphery wall 233 extending downward from the periphery of the baffle and an upper periphery wall 234 extending downward from the periphery of the baffle, the upper periphery wall is screwed to the upper housing 22 so as to assemble the upper housing and the lower housing together, so that the annular positioning groove 21 is formed between the bottom surface of the upper housing 23 and the annular protruding 231. The inner of the lower periphery of the lower housing 23 forms the assembly groove 24. The outer of the additional module 40 is disposed with an inner cover 41, the inner cover 41 is detachably attached inside the assembly groove 24 of the lower housing.

In this embodiment, the inner cover 41 comprises a bottom board 411 and a surrounding board 412 extending downward from the periphery of the bottom board 411, an outer cover 42 is provided to cover the surrounding board 412, the outer cover 42 is disposed with a plurality of air outlet holes. The additional module 40 is attached inside the inner cover 41. in a preferred embodiment, the inner of the fixation base 20 is disposed with a first magnet 28, the inner side of the inner cover 41 is disposed with a second magnet 45, the first magnet 28 and the second magnet 45 can attract each other, so that the inner cover 41 and the lower housing are detachable, but not limited to this, other structures are available as needed, for example screwing structure.

The additional module 40 further comprises a flavor box 43 and a cover plate 44 covering the opening of the flavor box 43, the flavor box is filled with flavor, as needed, the flavor box 43 can be disposed with a second assembly base to assemble the second magnet. The flavor box 43 is detachably or non-detachably fixed inside the inner cover.

The fixation base 20 further comprises an impeller fixation base fixedly attached between the upper housing and the baffle, the impeller fixation base comprises a water inlet, a water outlet and a cavity connecting the water inlet and the water outlet; in this embodiment, the impeller fixation base comprises an upper impeller fixation element 25 and a lower impeller fixation element 26, which are oppositely arranged and fixedly connected. The impeller fixation base is pivotly disposed with a first rotation shaft 27, the first rotation shaft 27 is fixedly disposed with an impeller, the impeller rotates under the compact of water, the waterway comprises at least the water inlet, the water outlet and the cavity. In a preferred embodiment, a first assembly base to position the first magnet 28 is disposed between the baffle and the impeller fixation base, the first assembly base can be an assembly groove disposed at the baffle 232, the lower impeller fixation element 26 covers the assembly groove so as to position the first magnet. The inner cover 41 is pivotly disposed with a fan 46, the fan 46 is disposed with a second rotation shaft 461, the second rotation shaft 461 rotationally runs through the flavor box 43 and the cover plate 44; the first rotation shaft 27 rotationally runs through the baffle to fix to the second rotation shaft 461 coaxially to drive the fan 46 to rotate. The fan 46 rotates under the work of hydraulic power so as to give off perfume.

In this embodiment, the additional module is further disposed with the fan, but not limited to this, it can be disposed without the fan as needed, the flavor box can be directly assembled inside the assembly groove.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. An outlet mechanism with additional function, comprising:

a fixation base assembled to a shower arm with an inlet, an outlet and a waterway connecting the inlet and the outlet, the inlet being connected to the shower arm;

a hand shower connected to the outlet of the fixation base by a flexible pipe and detachably fixedly connected to the fixation base; and an additional module detachably attached to the fixation base;

wherein:

the hand shower has an assembly hole, and further includes a movable lock catch, an elastic element and an operation element, the movable lock catch being movably attached to the hand shower and configured to move between a lock position and an unlock position inside the assembly hole, the elastic element being connected to the movable lock catch and the hand shower and configured to keep the movable lock catch in the lock position, the operation element being drivingly connected to the movable lock catch and movably attached to the hand shower;

an external periphery of the fixation base has a positioning groove, the assembly hole of the hand shower forms a sleeve on an outside of the fixation base, and the movable lock catch is configured to, when in the lock position, insert into the positioning groove;

the fixation base comprises an upper housing and a lower housing, the lower housing being fixed to the upper housing and comprising a baffle and a lower periphery wall extending downwardly from a periphery of the baffle, an assembly groove being formed in an inner side of the lower periphery wall; and an inner cover is disposed at an outer side of the additional module, the inner cover being detachably assembled inside the assembly groove of the lower housing.

2. The outlet mechanism with additional function according to claim 1, wherein the fixation base comprises an upper housing and a lower housing, the lower housing being fixed to the upper housing and having an annular protrusion extending outwardly, said positioning groove being formed between a bottom surface of the upper housing and the annular protrusion and having an annular shape.

3. The outlet mechanism with additional function according to claim 2, wherein the additional module is a music player module.

4. The outlet mechanism with additional function according to claim 1, wherein the movable lock catch is slidably connected to the hand shower.

5. The outlet mechanism with additional function according to claim 4, wherein the additional module is a music player module.

6. The outlet mechanism with additional function according to claim 1, wherein the operation element is slidably connected to the hand shower and has a first inclined surface, the movable lock catch has a second inclined surface, and the first inclined surface abuts the second inclined surface.

7. The outlet mechanism with additional function according to claim 6, wherein the additional module is a music player module.

8. The outlet mechanism with additional function according to claim 1, wherein the fixation base includes a first magnet, the inner cover includes a second magnet, and the first magnet and the second magnet attract each other.

9. The outlet mechanism with additional function according to claim 8, wherein the additional module is a music player module.

10. The outlet mechanism with additional function according to claim 8, wherein the additional module is an aromatherapy module.

11. The outlet mechanism with additional function according to claim 10, wherein:

the fixation base further comprises an impeller fixation base fixedly attached between the upper housing and the baffle;

the impeller fixation base comprises a water inlet, a water outlet, a cavity connecting the water inlet and the water outlet, and a first rotation shaft with an impeller configured to rotate under an impact of water;

the waterway comprises at least the water inlet, the water outlet and the cavity; and a fan with a second rotation shaft is disposed within the inner cover, the first rotation shaft extending through the baffle and being coaxially fixedly attached to the second rotation shaft.

12. The outlet mechanism with additional function according to claim 1, wherein the additional module is a music player module.

13. The outlet mechanism with additional function according to claim 1, wherein the additional module is an aromatherapy module.

14. The outlet mechanism with additional function according to claim 13, wherein:

the fixation base further comprises an impeller fixation base fixedly attached between the upper housing and the baffle;

the impeller fixation base comprises a water inlet, a water outlet, a cavity connecting the water inlet and the water outlet, and a first rotation shaft with an impeller configured to rotate under an impact of water;

the waterway comprises at least the water inlet, the water outlet and the cavity; and a fan with a second rotation shaft is disposed within the inner cover, the first rotation shaft extending through the baffle and being coaxially fixedly attached to the second rotation shaft.

15. The outlet mechanism with additional function according to claim 1, wherein the additional module is a music player module.

16. The outlet mechanism with additional function according to claim 1, wherein the additional module is a music player module.

* * * * *